US006432891B1

(12) United States Patent
O'Connor

(10) Patent No.: US 6,432,891 B1
(45) Date of Patent: Aug. 13, 2002

(54) MALODOR COUNTERACTANT COMPOSITIONS AND METHODS FOR PREPARING AND USING SAME

(75) Inventor: Simon O'Connor, Walthamstow (GB)

(73) Assignee: Bush Boake Allen Inc.,, Montvale, NJ (US)

( * ) Notice: Subject to any disclaimer, the term of this patent is extended or adjusted under 35 U.S.C. 154(b) by 0 days.

(21) Appl. No.: 09/886,546

(22) Filed: Jun. 21, 2001

(30) Foreign Application Priority Data

Jun. 23, 2000 (GB) ..... 0015470

(51) Int. Cl.[7] ..... C11D 3/50
(52) U.S. Cl. ..... 510/106; 512/23
(58) Field of Search ..... 510/106; 512/23

(56) References Cited

U.S. PATENT DOCUMENTS 4,310,512 A * 1/1982 Schleppnik ..... 424/76
4,622,221 A * 11/1986 Schleppnik ..... 424/76
4,719,105 A * 1/1988 Schleppnik ..... 424/76.21
5,650,385 A * 7/1997 Dunn et al. ..... 510/245
5,929,022 A * 7/1999 Velazquez ..... 510/499

* cited by examiner

*Primary Examiner*—John Hardee
(74) *Attorney, Agent, or Firm*—Richard R. Muccino

(57) ABSTRACT

This invention pertains to a method of counteracting a malodor in a solid or liquid, soap or detergent caused by a compound selected from the group consisting of lower carboxylic acids, thiols, thiophenols, phenols, lower amines, phosphines, arsines, lower alcohols, and lower ketones. The method comprises introducing into the solid or liquid, soap or detergent an effective malodor counteracting amount of a malodor counteracting compound selected from the group consisting of 1-cyclohexyl-ethyl-butyrate, 1-cyclohexyl-ethyl-acetate, 1-cyclohexyl-ethanol, 4-isopropyl-cyclohexyl-propionate, and phenoxyacetic acid 2-hydroxy-ethyl ester. The perceived total odor intensity in the solid or liquid, soap or detergent is reduced and the perceived malodor intensity in the solid or liquid, soap or detergent is substantially eliminated. The malodor counteractant compositions may be used in a wide variety of solid or liquid, soaps or detergents.

19 Claims, No Drawings

MALODOR COUNTERACTANT COMPOSITIONS AND METHODS FOR PREPARING AND USING SAME

BACKGROUND OF THE INVENTION

1. Field of the Invention

This invention pertains to a method of counteracting a malodor in a solid or liquid, soap or detergent caused by a compound selected from the group consisting of lower carboxylic acids, thiols, thiophenols, phenols, lower amines, phosphines, arsines, lower alcohols, and lower ketones. The method comprises introducing into the solid or liquid, soap or detergent an effective malodor counteracting amount of a malodor counteracting compound selected from the group consisting of 1-cyclohexyl-ethyl-butyrate, 1-cyclohexyl-ethyl-acetate, 1-cyclohexyl-ethanol, 4-isopropyl-cyclohexyl-propionate, and phenoxyacetic acid 2-hydroxy-ethyl ester. The perceived total odor intensity in the solid or liquid, soap or detergent is reduced and the perceived malodor intensity in the solid or liquid, soap or detergent is substantially eliminated. The malodor counteractant compositions may be used in a wide variety of solid or liquid, soaps or detergents.

2. Description of the Background

A wide variety of solid and liquid, soaps and detergents have been developed for cleaning purposes that are offensive to the sense of smell. Particularly unpleasant odors are caused by compounds which have the ability to donate or accept protons such as lower carboxylic acids, thiols, thiophenols, phenols, lower amines, phosphines, arsines, lower alcohols, and lower ketones. Compounds of this type that have unpleasant odors are known as malodor compounds.

Conventional perfumes include a variety of fragrance materials that provide a pleasant perfume that masks the malodor compound generally by one of two mechanisms. In the first mechanism, the masking fragrance blends with the malodor compound to provide a different and more desirable aroma. In the second mechanism, the masking fragrance is employed in a large quantity to overwhelm the malodor compound.

Unfortunately both types of perfuming mechanisms have serious disadvantages. Neither perfume completely eliminates the perception of malodor and so there is a tendency to use increasing amounts of the fragrance to completely eliminate the perception of malodor. Furthermore, the masking effect is an additive effect and so the total odor level in the freshened solid or liquid, soap or detergent is increased by consumption of the perfume. Even though the fragrances used in the perfume may be very pleasant at low concentration, the total odor level in the solid or liquid, soap or detergent at the relatively high concentrations required to achieve moderate masking of the malodor may itself be offensive.

U.S. Pat. No. 4,009,253 (Schleppnik et al. '253) discloses a method of treating malodors to alleviate their offensiveness. The method comprises treating the air containing the malodor with an amount of 4-cyclohexyl-4-methyl-2-pentanone, $CH_3C(CH_3)(C_6H_{11})CH_2COCH_3$, effective to counteract the malodor.

U.S. Pat. No. 4,187,251 (Schleppnik et al. '251) discloses the use of 4-ethylcyclohexyl methyl ketone, $4\text{-}CH_3CH_2(C_6H_{10})COCH_3$, and 4-isopropylcyclohexyl methyl ketone, $4\text{-}(CH_3)_2CH(C_6H_{10})COCH_3$. Other compounds disclosed as being useful in the invention are 4-tert-butylcyclohexyl methyl ketone, $4\text{-}(CH_3)_3C(C_6H_{10})COCH_3$; 2-methyl-4-tert-butylcyclohexyl methyl ketone, $2\text{-}(CH_3)\text{-}4\text{-}(CH_3)_3C(C_6H_9)COCH_3$; 2-methyl-5-isopropylcyclohexyl methyl ketone, $2\text{-}(CH_3)\text{-}5\text{-}(CH_3)_2CH(C_6H_9)COCH_3$; 4-methylcyclohexyl isopropyl ketone, $4\text{-}(CH_3)(C_6H_{10})COCH(CH_3)_2$; 4-methylcyclohexyl sec-butyl ketone, $4\text{-}(CH_3)(C_6H_{10})COCH(CH_3)CH_2CH_3$; 4-methylcyclohexyl isobutyl ketone, $4\text{-}(CH_3)(C_6H_{10})COCH_2CH(CH_3)_2$; 2,4-dimethylcyclohexyl methyl ketone, $2,4\text{-}(CH_3)_2(C_6H_9)COCH_3$; 2,3-dimethylcyclohexyl methyl ketone, $2,3\text{-}(CH_3)_2(C_6H_9)COCH_3$; 2,2-dimethylcyclohexyl methyl ketone, $2,2\text{-}(CH_3)_2(C_6H_9)COCH_3$; 3,3-dimethylcyclohexyl methyl ketone, $3,3\text{-}(CH_3)_2(C_6H_9)COCH_3$; 4,4-dimethylcyclohexyl methyl ketone, $4,4\text{-}(CH_3)_2(C_6H_9)COCH_3$; 3,3,5-trimethylcyclohexyl methyl ketone, $3,3,5\text{-}(CH_3)_3(C_6H_8)COCH_3$; and 2,2,6-trimethylcyclohexyl methyl ketone, $2,2,6\text{-}(CH_3)_3(C_6H_8)COCH_3$.

U.S. Pat. No. 4,310,512 (Schleppnik et al. '512) discloses a fragrance composition having malodor counteractant properties comprising a compound having malodor counteractant properties and fragrance materials. The compound having malodor counteractant properties has the formula: $ABC—C_6H_2—X—(CH_2)_nCOZ$; wherein A, B and C are hydrogen or an alkyl group of 1 to 6 carbon atoms provided that the total combined number of carbon atoms of A, B, C does not exceed 8 carbon atoms; X is oxygen; n represents 1 to 2; and Z represents a monohydroxy alkyl group of 2 to 7 carbon atoms. Representative compounds include 2-hydroxyethyl phenoxyacetate, 2-hydroxyethyl p-tert-butylphenoxyacetate, 6-hydroxylhexyl phenoxyacetate, 4-hydroxybutyl phenoxyacetate, 3-hydroxypropyl-2'-methylphenoxyacetate, 3-hydroxy-1-butyl phenoxyacetate, 1-hydroxy-3-butyl phenoxyacetate, 3-hydroxypropyl phenoxyacetate, 2-hydroxy-1-propyl phenoxyacetate, 1-hydroxy-2-propyl phenoxyacetate, 2-hydroxy-1-propyl-p-isopropylphenoxyacetate, 1-hydroxy-2-propyl-p-isopropylphenoxyacetate, 2-hydroxyethyl 3',4'-dimethylphenoxyacetate, 2'-hydroxyethyl 3-phenoxypropionate. The formula, $ABC—C_6H_2—X—(CH_2)_nCOZ$, could include phenoxyacetic acid 2-hydroxy-ethyl ester $(C_6H_5)OCH_2COO(CH_2)_2OH$.

U.S. Pat. No. 4,622,221 (Schleppnik et al. '221) discloses a method of counteracting a malodor in air caused by a compound selected from the group consisting of lower carboxylic acids, thiols, thiophenols phenols, lower amines, phosphines and arsines. The method comprises introducing into the air an effective malodor counteracting amount of cyclohexyl-1-ethyl-n-butyrate or cyclohexyl-1-ethyl-acetate whereby the perceived total odor intensity in the air is reduced and the perceived malodor intensity in the air is substantially eliminated.

Malodor counteractants having the formula $C_6H_{11}—CR_1R_2OX$ are also disclosed. In this formula, $R_1$ is $C_{1-5}$ alkyl, $R_2$ is selected from the group consisting of hydrogen and $C_{1-5}$ alkyl and X is $—COR_3$ wherein $R_3$ is selected from the group consisting of hydrogen and $C_{1-6}$ alkyl. Schleppnik et al. '221 claims cyclohexyl-1ethyl-n-butyrate or cyclohexyl-1-ethyl-acetate.

U.S. Pat. No. 4,701,278 (Fehr) discloses a method to enhance flowery type perfume notes reminiscent of those developed by lily of the valley and coriander. The method comprises adding a fragrance effective amount of cyclohexyl-2-methyl-2-butanol, $C_6H_{11}\text{-}(CH_2)_2C(CH_3)_2OH$, in admixture with other perfume coingredients.

U.S. Pat. No. 4,719,105 (Schleppnik et al. '105) discloses a method of counteracting a malodor in air caused by a compound selected from the group consisting of lower carboxylic acids, thiols, thiophenols, phenols, lower amines, phosphines, and arsines. The method comprises introducing into the air an effective malodor counteracting amount of cyclohexyl-1-ethanol whereby the perceived total odor intensity in the air is reduced and the perceived malodor intensity in the air is substantially eliminated. Malodor counteractants having the formula $C_6H_{11}$—$CR_1R_2OX$ are also disclosed. In this formula, $R_1$ is $C_{1-5}$ alkyl, $R_2$ is selected from the group consisting of hydrogen and $C_{1-5}$ alkyl and X is hydrogen. Schleppnik et al. '105 claims cyclohexyl-1-ethanol.

U.S. Pat. No. 5,049,544 (Koshino et al.) discloses a perfumery composition comprising 2-cyclohexylpropionic acid or a derivative represented by the formula: $C_6H_{11}CH(CH_3)COOR$. In this formula, R is a hydrogen atom, an alkyl group having 1–4 carbon atoms, or an alkenyl group having 2–4 carbon atoms. Representative compounds include ethyl 2-cyclohexylpropionate, methyl 2-cyclohexylpropionate, 2-cyclohexylpropionic acid, isopropyl 2-cyclohexylpropionate, 2-cyclohexylpropionate, and tert-butyl 2-cyclohexylpropionate.

U.S. Pat. No. 5,100,872 (Narula et al.) discloses a number of alkyl cyclohexylmethyl and cyclohexenylmethyl carbonate compounds including isocyclogeraniol carbonates, cyclohexene carbonates, cyclohexane carbonates, norbornene carbonates, and dihydroisocyclogeraniol carbonates.

U.S. Pat. No. 5,676,163 (Behan et al.) discloses a process for counteracting smoke malodors in an enclosed public air space or substrate subject to such malodors. The method comprises contacting the space or support with an effective counteracting amount a perfumery aldehyde having the formula, CHO—$C_6H_3R_1R_2$, wherein $R_1$ and $R_2$ are selected from the group consisting of hydrogen, alkyl, hydroxyl, and alkoxy, or together comprise methylenedioxy.

U.S. Pat. No. 5,683,979 (Schreck et al.) discloses a composition consisting essentially of from about 20% to about 60% of GALAXOLIDE™, which is a musk aroma material consisting of a mixture of tricyclic compounds, and from about 30% to about 70% of CITRAL™, which is a citrus aroma material, and from about 1% to about 20% of corn mint oil.

U.S. Pat. No. 5,888,962 (Frank et al.) discloses a perfumery material comprising a mixture of 3-methyl-5-phenyl-pentanenitrile and 3-methyl-5-cyclohexyl-pentanenitrile.

While the above compositions provide some degree of freshening action, none of the above compositions are satisfactory malodor counteractant compositions in solid or liquid, soaps or detergents. Malodor counteractants useful for counteracting a malodor in air would not be expected to be useful as malodor counteractants for counteracting a malodor in solid and liquid soaps and detergents. The malodors present in air are volatile compounds while the malodors present in soaps and detergents are generally fatty acids, which are not very volatile compounds, and are only present in the headspace of the soaps and detergents. Accordingly, the malodors present in air and the malodors present in soaps and detergents are different classes of compounds and hence the malodor counteractants useful in air would not be expected to be useful as malodor counteractants in soaps and detergents. A malodor counteractant must be in the same volatility range as the malodor itself. Malodor counteractant air fresheners are designed to deliver a malodor counteractant into air such that it will be effective for the envisaged application. For a malodor counteractant composition in a solid or liquid, soap or detergent to have optimum performance in both reducing malodor and not adding a masking odor, the formulation must be such that the counteractant achieves sufficient concentration in the headspace but does not build up in air as an air freshener would. The present invention provides malodor counteractant compositions without the disadvantages which are characteristic of previously known products. The present invention also provides methods for preparing and using these malodor counteractant compositions and the compositions in which they may be employed. The malodor counteractant compositions may be used in a wide variety of solid or liquid, soap or detergents.

SUMMARY OF THE INVENTION

The present invention is directed at a method of counteracting a malodor in a solid or liquid, soap or detergent caused by a compound selected from the group consisting of lower carboxylic acids, thiols, thiophenols, phenols, lower amines, phosphines, arsines, lower alcohols, and lower ketones, comprising introducing into the solid or liquid, soap or detergent an effective malodor counteracting amount of a malodor counteracting compound selected from the group consisting of 1-cyclohexyl-ethyl-butyrate, 1-cyclohexyl-ethyl-acetate, 1-cyclohexyl-ethanol, 4-isopropyl-cyclohexyl-propionate, and phenoxyacetic acid 2-hydroxy-ethyl ester, whereby the perceived total odor intensity in the solid or liquid, soap or detergent is reduced and the perceived malodor intensity in the solid or liquid, soap or detergent is substantially eliminated.

The malodor counteractant compositions may further comprise a fragrance material such that the perceived total odor intensity in the solid or liquid, soap or detergent is reduced and the perceived malodor intensity in the solid or liquid, soap or detergent is substantially eliminated. The malodor counteractant compositions may be used in a wide variety of solid and liquid, soaps and detergents. The present invention also pertains to methods for preparing and using the malodor counteractant compositions and the soap and detergent products in which they may be used.

DETAILED DESCRIPTION OF THE INVENTION

The present invention relates to malodor counteractant compositions comprising an organoleptically effective amount of a malodor counteractant agent in a solid or liquid, soap or detergent. Typical malodor compounds include lower aliphatic carboxylic acids, lower aliphatic amines, and sulfur compounds such as $H_2S$, lower aliphatic mercaptans, aromatic mercaptans, dimethy sulfides, phosphines, arsines, lower alcohols, and lower ketones. Applicant has discovered malodor counteractant agents that reduce or eliminate the perception of malodor without increasing the total odor level. Unlike odor masking agents, which increase the overall odor level without eliminating the perception of the odor, malodor counteractant agents abate a given malodor while reducing the combined intensity of the odor level. Applicant believes that the malodor counteractant agents counteract the perception of malodors because the counteractant agents bind to the same receptor sites in the nose as the malodor compounds. Applicant believes that the malodor counteractant agents competitively interact and bind with proteins at the receptor sites and thereby render the sites unavailable to malodor compounds. When a base odor problem is encountered, a number of samples are prepared and tested, dosed at up to 0.1%, to find those samples which have the best performance for suppressing the perception of base odor. When more than one malodor counteractant proves to be effective, combinations of the best performers may be tested to find the optimum mixture. The malodor counteractant compositions may further comprise a fragrance material such that the perceived total odor intensity in the solid or liquid, soap or detergent is reduced and the perceived malodor intensity in the solid or liquid, soap or detergent is substantially eliminated. The malodor counteractant compositions may be used in a wide variety of solid and liquid, soaps and detergents, especially personal care products such as toilet and beauty soaps, shower gels, and facial creams and lotions. The present invention also pertains to methods for preparing and using the malodor counteractant compositions and the soap and detergent products in which they may be used.

As set out above, typical malodor compounds include lower aliphatic carboxylic acids, lower aliphatic amines, and sulfur compounds such as $H_2S$, lower aliphatic mercaptans, aromatic mercaptans, dimethy sulfides, phosphines, arsines, lower alcohols, and lower ketones. Preferably, the malodor compound in the present invention is a lower aliphatic carboxylic acid.

The malodor counteractants employed in the present invention are the following:

1-Cyclohexyl-ethyl-butyrate $(C_6H_{11})CH(CH_3)OCO(CH_2)_2CH_3$

1-Cyclohexyl-ethyl-acetate $(C_6H_{11})CH(CH_3)OCOCH_3$

1-Cyclohexyl-ethanol $(C_6H_{11})CH(CH_3)OH$

4-Isopropyl-cyclohexyl-propionate $4\text{-}[(CH_3)_2CH(C_6H_{11})]OCOCH_2CH_3$

Phenoxyacetic acid 2-hydroxy-ethyl ester $(C_6H_5)OCH_2COO(CH_2)_2OH$

Preferably, the malodor counteracting compound is selected from the group consisting of 1-cyclohexyl-ethyl-butyrate, 1-cyclohexyl-ethyl-acetate, 1-cyclohexyl-ethanol, and 4-isopropyl-cyclohexyl-propionate. More preferably, the malodor counteracting compound is 1-cyclohexyl-ethanol or 4 -isopropyl-cyclohexyl-propionate. Most preferably, the malodor counteracting compound is 4-isopropyl-cyclohexyl-propionate. In another preferred embodiment, the malodor counteracting compound is a mixture of cyclohexyl-ethyl-acetate and 4-isopropyl-cyclohexyl-propionate.

In a first specific embodiment, the malodor counteracting compound is 1-cyclohexyl-ethyl-butyrate. In a second specific embodiment, the malodor counteracting compound is 1-cyclohexyl-ethyl-acetate. In a third specific embodiment, the malodor counteracting compound is 1-cyclohexyl-ethanol. In a fourth specific embodiment, the malodor counteracting compound is 4-isopropyl-cyclohexyl-propionate. In a fifth specific embodiment, the malodor counteracting compound is phenoxyacetic acid 2-hydroxy-ethyl ester.

Optionally, a number of fragrant organic materials may be tested as a 50/50 mixture with the malodor counteractants selected. The fragrant organic molecules are selected to have as neutral a smell as possible so as not to add an odor, but rather to enhance the effect of suppressing the perception of the base odor. Examples of organic molecules which may be used include terpenes, e.g., nopyl acetate, esters, e.g., benzyl salicylate, alcohols, e.g., phenyl ethyl alcohol, aldehydes, e.g., amyl cinnamic aldehyde, and musks, e.g., abbalide.

In a specific embodiment, the method of the present invention comprising introducing into the solid or liquid, soap or detergent an effective malodor counteracting amount of a mixture comprising from about 0.5% to about 10% of a solution of ambroxan in dipropylene glycol (DPG), about 9.5% of boisvelone, about 10% of lyral, about 30% of phenyl propyl alcohol, about 10% of 1-cyclohexyl-ethyl-acetate, and about 40% of 4-isopropyl-cyclohexyl-propionate.

The following terms are used throughout the specification and are defined as follows unless otherwise indicated.

The terms "odor", "fragrance", and "smell", as used herein, are used interchangeably whenever a compound is referred to as an organoleptic which is intended to stimulate the sense of smell.

The term "organoleptically", as used herein, refers to compounds of the invention which stimulate the sense of smell, and are thus perceived as having a characteristic odor.

The term "organoleptic effective amount", as used herein, means a level or amount of a fragrant agent(s) present in a composition at which the incorporated agent(s) exhibit(s) a sensory effect.

Throughout this disclosure, applicant will suggest various theories or mechanisms by which applicant believes the components in the malodor counteracting compositions function together in an unexpected manner to reduce the perceived total odor intensity in the solid or liquid, soap or detergent and substantially eliminate the perceived malodor intensity in the solid or liquid, soap or detergent. While applicant may offer various mechanisms to explain the present invention, applicant does not wish to be bound by theory. These theories are suggested to better understand the present invention but are not intended to limit the effective scope of the claims.

In accord with the present invention, a method is provided for counteracting a malodor in a solid or liquid, soap or detergent caused by a compound selected from the group consisting of lower carboxylic acids, thiols, thiophenols, phenols, lower amines, phosphines, arsines, lower alcohols, and lower ketones. The method comprises introducing into the solid or liquid, soap or detergent an effective malodor counteracting amount of a malodor counteracting compound selected from the group consisting of 1-cyclohexyl-ethyl-butyrate, 1-cyclohexyl-ethyl-acetate, 1-cyclohexyl-ethanol, 4-isopropyl-cyclohexyl-propionate, and phenoxyacetic acid 2-hydroxy-ethyl ester. The perceived total odor intensity in the solid or liquid, soap or detergent is reduced and the perceived malodor intensity in the solid or liquid, soap or detergent is substantially eliminated.

In a preferred embodiment, the malodor counteracting compound is selected from the group consisting of 1-cyclohexyl-ethyl-butyrate, 1-cyclohexyl-ethyl-acetate, 1-cyclohexyl-ethanol, and 4-isopropyl-cyclohexyl-propionate. In a more preferred embodiment, the malodor counteracting compound is 1-cyclohexyl-ethanol or 4-isopropyl-cyclohexyl-propionate. In a most preferred embodiment, the malodor counteracting compound is 4-isopropyl-cyclohexyl-propionate. In another preferred embodiment, the malodor counteracting compound is a mixture of cyclohexyl-ethyl-acetate and 4-isopropyl-cyclohexyl-propionate.

In a most preferred embodiment, the method of the present invention comprises introducing into the solid or liquid, soap or detergent an effective malodor counteracting amount of a mixture comprising from about 0.5% to about 10% of a solution of ambroxan in dipropylene glycol, about 9.5% of boisvelone, about 10% of lyral, about 30% of phenyl propyl alcohol, about 10% of cyclohexyl-ethyl-acetate, and about 10% of 4-isopropyl-cyclohexyl-propionate.

The malodor counteractant agents of the present invention may be used in many distinct physical forms well known in the pharmaceutical art to provide an initial dosage of the malodor counteractant agent and/or a further time-release form of the malodor counteractant agent. Without being limited thereto, such physical forms include free forms and encapsulated forms, and mixtures thereof.

The amount of the inventive malodor counteractant agent employed in a solid or liquid, soap or detergent is an organoleptically effective amount to provide a malodor counteractant composition that abates a given malodor while reducing the combined intensity of the odor level. The exact amount of malodor counteractant agent used may vary depending upon the type of malodor counteractancy agent employed, the type of vehicle employed, and the level of malodor counteractancy desired. In general, the amount of malodor counteractant agent present is the ordinary dosage required to obtain the desired result. Such dosages are known to the skilled practitioner in the arts and are not a part of the present invention. In a preferred embodiment, the malodor counteractant agent in the malodor counteractant composition is present in an amount from about 0.0001% to about 10%, preferably from about 0.001% to about 5%, and more preferably from about 0.01% to about 2%, by weight.

The present invention extends to methods for preparing the malodor counteractant compositions. In such a method, the malodor counteractant composition is prepared by admixing one or more malodor counteractant agent in a vehicle, together with any optional ingredients, to form a uniform mixture. The final compositions are readily prepared using standard methods and apparatus generally known by those skilled in the confectionery arts. The apparatus useful in accordance with the present invention comprises mixing apparatus well known in the arts, and therefore the selection of the specific apparatus will be apparent to the artisan.

The malodor counteractant agents may be used in a wide variety of vehicles. The combination of the malodor counteractant agent of the present invention together with a vehicle and optional ingredients, when desired, provides a malodor counteractant composition that abates a given malodor while reducing the combined intensity of the odor level.

The present invention includes laundry and cleaning products which are typically used for laundering fabrics and cleaning hard surfaces such as dishware and other surfaces in need of cleaning or disinfecting. These compositions include not only detergent compositions which provide fabric cleaning benefits but also laundry compositions such as rinse added fabric softener compositions and dryer added compositions (sheets) which provide softening or antistatic benefits. The malodor counteracting compound(s) of the present invention may comprise from about 0.01% to about 10%, preferably from about 0.05% to about 5%, and more preferably from about 0.1% to about 2%, by weight of the laundry or cleaning product composition. Optional ingredients useful for formulating such laundry and cleaning compositions according to the present invention include one or more of the following.

The preferred fabric softening agents to be used in the present invention compositions are quaternary ammonium compounds or amine precursors. The alkyl or alkenyl chains in the quaternary ammonium compounds or amine precursors must contain at least 11 carbon atoms, preferably at least 16 carbon atoms. The chain may be straight or branched. The term "amine precursors" refers to secondary or tertiary amines corresponding to the quaternary ammonium compounds, the amines being substantially protonated. Tallow is a convenient and inexpensive source of long chain alkyl and alkenyl groups useful in the quaternary ammonium compound or amine precursors. Specific examples of quaternary ammonium compounds suitable for use in the aqueous fabric softening compositions include:

1) N,N-di(tallowyl-oxyethyl)-N,N-dimethyl ammonium chloride;
2) N,N-di(tallowyl-oxyethyl)-N-methyl, N-(2-hydroxyethyl) ammonium chloride;
3) N,N-di(2-tallowyl-oxy-2-oxoethyl)-N,N-dimethyl ammonium chloride;
4) N,N-di(2-tallowyl-oxyethylcarbonyloxyethyl)-N,N-dimethyl ammonium chloride;
5) N-(2-tallowyl-oxy-2-ethyl)-N-(2-tallowyl-oxy-2-oxoethyl)-N,N-dimethyl ammonium chloride;
6) N,N,N-tri(tallowyl-oxyethyl)-N-methyl ammonium chloride;
7) N-(2-tallowyloxy-2-oxoethyl)-N-(tallowyl)-N,N-dimethyl ammonium chloride; and
8) 1,2-ditallowyloxy-3-trimethylammoniopropane chloride.

Particularly preferred is N,N-di(tallowoyl-oxyethyl)-N,N-dimethyl ammonium chloride, where the tallow chains are at least partially unsaturated.

The level of unsaturation of the tallow chain can be measured by the Iodine Value (IV) of the corresponding fatty acid, which in the present case should preferably be in the range of from 5 to 100 with two categories of compounds being distinguished, having a IV below or above 25. For compounds made from tallow fatty acids having a IV of from 5 to 25, preferably 15 to 20, a cis/trans isomer weight ratio greater than about 30/70, preferably greater than about 50/50, and more preferably greater than about 70/30, provides optimal concentrability. For compounds made from tallow fatty acids having a IV of above 25, the ratio of cis to trans isomers is less critical unless very high concentrations are needed.

Other examples of suitable quaternary ammoniums may be obtained by replacing "tallow" in the above compounds with, for example, coco, palm, lauryl, oleyl, ricinoleyl, stearyl, palmityl, or the like, the fatty acyl chains being either fully saturated, or preferably at least partly unsaturated; replacing "methyl" in the above compounds with ethyl, ethoxy, propyl, propoxy, isopropyl, butyl, isobutyl or t-butyl; replacing "chloride" in the above compounds with bromide, methylsulfate, formate, sulfate, nitrate, and the like. The anion is merely present as a counterion of the positively charged quaternary ammonium compounds and is not critical to the practice of the present invention.

The quaternary ammonium or amine precursors compounds are present at levels of from about 1% to about 80% of the composition, depending on the composition which can be dilute with a preferred level of active from about 5% to about 15%, or concentrated with a preferred level of active from about 15% to about 50%, most preferably from about 15% to about 35%.

The pH of the fabric softening agents is an essential parameter since it influences the stability of the quaternary ammonium or amine precursors compounds, especially under prolonged storage conditions. The pH is measured in the neat compositions at 20° C. For optimum hydrolytic stability of these compositions, the neat pH must be in the range of from about 2.0 to about 4.5, preferably about 2.0 to about 3.5. The pH of these compositions can be regulated by the addition of a Bronsted acid. Examples of suitable acids include inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$, and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids.

Nonionic softening agents also useful in the present compositions, preferably in combination with cationic softening agents. Typically, such nonionic fabric softener materials have an HLB from about 2 to about 9, more typically from about 3 to about 7. Such nonionic fabric softener materials tend to be readily dispersed either by themselves, or when combined with other materials such as single-long-chain alkyl cationic surfactants. Dispersibility can be improved by using single-long-chain alkyl cationic surfactants. In general, the materials selected should be relatively crystalline, high melting, (e.g. >40° C.) and relatively water-insoluble. The level of optional nonionic softener in the compositions is typically from about 0.1% to about 10% preferably from about 1% to about 5% Preferred nonionic softeners are fatty acid partial esters of polyhydric alcohols, or anhydrides, wherein the alcohol, or anhydride, contains from 2 to 18, preferably from 2 to 8, carbon atoms, and each fatty acid moiety contains from 12 to 30, preferably from 16 to 20, carbon atoms. Typically, such softeners contain from one to 3, preferably 2 fatty acid groups per molecule. The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred. The fatty acid portion of the ester is normally derived from fatty acids having from 12 to 30, preferably from 16 to 20, carbon atoms, typical examples of the fatty acids being lauric acid, myristic acid, palmitic acid, stearic acid oleic and behenic acid. Highly preferred optional nonionic softening agents for use in the present invention are the sorbitan esters, which are esterified dehydration products of sorbitol, and the glycerol esters. Commercial sorbitan monostearate is a suitable material. Mixtures of sorbitan stearate and sorbitan palmitate having stearate/palmitate weight ratios varying between about 10:1 and about 1:10, and 1.5-sorbitan esters are also useful.

Glycerol and polyglycerol esters, especially glycerol, diglycerol, triglycerol, and polyglycerol mono-and/or all-esters, preferably mono-, are preferred. Useful glycerol and polyglycerol esters include mono-esters with stearic, oleic, palmitic, lauric, isostearic, myristic, and/or behenic acids and the diesters of stearic, oleic, palmitic, lauric, isostearic, behenic, and/or myristic acids. The typical mono-ester contains some di- and tri-ester, etc. The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred.

Suitable fabric softener agents useful may comprise one, two, or all three of the following fabric softening agents:

(a) the reaction product of higher fatty acids with a polyamine selected from the group consisting of hydroxyalkylalkylenediamines, dialkylenetriamines, and mixtures thereof, (preferably from about 10% to about 80%); and/or (b) cationic nitrogenous salts containing only one long chain acyclic aliphatic $C_{15}$–$C_{22}$ hydrocarbon group (preferably from about 3% to about 40%); and/or (c) cationic nitrogenous salts having two or more long chain acyclic aliphatic $C_{15}$–$C_{22}$ hydrocarbon groups or one the group and an arylalkyl group (preferably from about 10% to about 80%);

with the preferred percentages being by weight of the fabric softening agent component of the present invention compositions.

The amount of fabric softening agent (fabric softener) in liquid compositions of this invention is typically from about 2% to about 50%, preferably from about 4% to about 30%, by weight of the composition. The lower limits are amounts needed to contribute effective fabric softening performance when added to laundry rinse baths. The higher limits are suitable for concentrated products which provide the consumer with more economical usage due to a reduction of packaging and distribution cost.

Fully formulated fabric softening compositions preferably contain, in addition to the hereinbefore described components, one or more of the following ingredients.

Concentrated compositions of the present invention may require organic and/or inorganic concentration aids to go to even higher concentrations and/or to meet higher stability standards depending on the other ingredients. Surfactant concentration aids are typically selected from the group consisting of single long chain alkyl cationic surfactants; nonionic surfactants; amine oxides; fatty acids; or mixtures thereof, typically used at a level of from 0 to about 15% of the composition.

Inorganic viscosity control agents which can also act like or augment the effect of the surfactant concentration aids, include water-soluble, ionizable salts which can also optionally be incorporated into the compositions of the present invention. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 20,000 parts per million (ppm), preferably from about 20 to about 11,000 ppm, by weight of the composition. Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and may improve softness performance. These agents may stabilize the viscosity over a broader range of temperature, especially at low temperatures, compared to the inorganic electrolytes. Specific examples of alkylene polyammonium salts include 1-lysine monohydrochloride and 1,5-diammonium 2-methyl pentane dihydrochloride.

Another optional, but preferred, ingredient is a liquid carrier. The liquid carrier employed n the present compositions is preferably water. The level of water in the liquid carrier is preferably at least about 50%, most preferably at least about 60%, by weight of the carrier. Mixtures of water and low molecular weight alcohols (<200) are useful as the carrier liquid. Still other optional ingredients are soil release polymers, bacteriocides, colorants, perfumes, preservatives, optical brighteners, anti ionization agents, antifoam agents, and the like.

Enzymes are included in the formulations for a wide variety of fabric laundering purposes, including removal of protein-based, carbohydrate-based, or triglycerol-based stains, for example, and for the prevention of refugee dye transfer, and for fabric restoration. The enzymes incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermos/ability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.001 mg to about 3 mg, of active enzyme per gram of the composition. The compositions will typically comprise from about 0.001% to about 5%, preferably 0.01%–2% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniforms*. Another suitable protease is obtained from a strain of Bacillus, having maximum activity throughout the pH range of 8–12. Genetically modified variants, particularly of Protease C, are also included herein. Amylases include, for example, alpha-amylases. The cellulase usable include both bacterial or fungal cellulase. Preferably, they will have a pH optimum of between 5 and 9.5. Suitable lipase enzymes for detergent usage include those produced by microorganisms of the Pseudomonas group, such as Pseudomonas stutzeri ATCC 19.154. Peroxidase enzymes are used in combination with oxygen sources, e.g., percarbonate, perborate, persulfate, hydrogen peroxide, etc. They are used for "solution bleaching," to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. It may be desired to use, in combination with these peroxidases, materials viewed as being peroxidase accelerators such as phenolsulfonate and/or phenothiazine.

A preferred optional ingredient for use in the present compositions is an enzyme stabilizer. Enzymes for use in detergents can be stabilized by various techniques. The enzymes employed herein can be stabilized by the presence of water-soluble sources of calcium and/or magnesium ions in the finished compositions which provide such ions to the enzymes. Calcium ions are generally more effective than magnesium ions and are preferred if only one type of cation is being used. Typical detergents, especially liquids, will comprise from about 1 to about 30, preferably from about 2 to about 20, more preferably from about 5 to about 15, and most preferably from about 8 to about 12, millimoles of calcium ion per liter of finished composition. This can vary somewhat, depending on the amount of enzyme present and its response to the calcium or magnesium ions. The level of calcium or magnesium ions should be selected so that there is always some minimum level available for the enzyme, after allowing for complexation with builders, fatty acids, etc., in the composition. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. A small amount of calcium ion, generally from about 0.05 to about 0.4 millimoles per liter, is often also present in the composition due to calcium in the enzyme slurry and formula water. In solid detergent compositions the formulation may include a sufficient quantity of a water-soluble calcium ion source to provide such amounts in the laundry liquor. In the alternative, natural water hardness may suffice. The foregoing levels of calcium and/or magnesium ions are sufficient to provide enzyme stability. More calcium and/or magnesium ions can be added to the compositions to provide an additional measure of grease removal performance. Accordingly, as a general proposition the compositions herein will typically comprise from about 0.05% to about 2% by weight of a water-soluble source of calcium or magnesium ions, or both. The amount can vary, of course, with the amount and type of enzyme employed in the composition.

The compositions herein may also contain various additional stabilizers, especially borate-type stabilizers. Typically, such stabilizers will be used at levels in the compositions from about 0.25% to about 10%, preferably from about 0.5% to about 5%, more preferably from about 0.75% to about 3%, by weight of boric acid or other borate compound capable of forming boric acid in the composition (calculated on the basis of boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid. It is to be recognized that such materials may also be used in formulations as the sole stabilizer as well as being used in combination with added calcium and/or magnesium ions. Finally, it may be desired to add chlorine scavengers, especially to protease-containing compositions, to protect the enzymes from chlorine typically present in municipal water supplies.

Various other ingredients may also be used to provide fully-formulated detergent compositions. The following ingredients are described for the convenience of the formulator, but are not intended to be limiting.

Nonlimiting examples of detersive surfactants useful at levels from about 1% to about 55%, by weight, include the conventional $C_{11}$–$C_{18}$ alkyl benzene sulfonates and primary, branched-chain and random $C_{11}$–$C_{20}$ alkyl sulfates, the $C_{10}$–$C_{18}$ secondary (2,3) alkyl sulfates, unsaturated sulfates such as oleyl sulfate, the $C_{10}$–$C_{18}$ alkyl alkoxy sulfates, $C_{10}$–$C_{18}$ alkyl alkoxy carboxylates, the $C_{10}$–$C_{18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. Conventional nonionic and amphoteric surfactants such as the $C_{12}$–$C_{18}$ alkyl ethoxylates including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines, $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful.

Detergent builders can be included in the compositions herein to assist in controlling mineral hardness. Inorganic as well as organic builders can be used. Builders are typically used in fabric laundering compositions to assist in the removal of particulate soils. The level of builder can vary widely depending upon the end use of the composition and its desired physical form. When present, the compositions will typically comprise at least about 1% builder, preferably from about 1% to about 80%. Liquid formulations typically comprise from about 5% to about 50%, more typically about 5% to about 30%, by weight, of detergent builder. Granular formulations typically comprise from about 1% to about 80%, more typically from about 5% to about 50% by weight, of the detergent builder.

Inorganic or Phosphorus-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, physic acid, silicates, carbonates (including bicarbonates and sesquicarbonates), sulfates, and aluminosilicates.

However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.0:1 to 3.2:1 and layered silicates. Unlike zeolite builders, the NaSKS-6 silicate builder does not contain aluminum NaSKS-6 has the delta-Na2 SiO5 morphology form of layered silicate. Layered silicates, such as those having the general formula $NaMSi_xO_{2x+1}.yH_2O$, wherein M is sodium or hydrogen, x is a number from 1.9 to 4, preferably 2, and y is a number from 0 to 20, preferably 0 can be used herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates.

Aluminosilicate builders are useful in the present invention. Aluminosilicate builders are of great importance in most currently marketed heavy duty granular detergent compositions, and can also be a significant builder ingredient in liquid detergent formulations. Useful aluminosilicate ion exchange materials are commercially available. These aluminosilicates can be crystalline or amorphous in structure and can be naturally-occurring aluminosilicates or synthetically derived. Preferred synthetic crystalline aluminosilicate ion exchange materials useful herein are available under the designations Zeolite A, Zeolite P (B), Zeolite MAP and Zeolite X. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate. Suitable ether polycarboxylates also include cyclic compounds, particularly alicyclic compounds.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, pyromellitic, succinic acid, oxydisuccinic acid, polymaleic acid, benzene 1,3,5-tricarboxylic acid, carboxymethyloxysuccinic acid. and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and related compounds. Useful succinic acid builders include the $C_5$–$C_{20}$ alkyl and alkenyl succinic acids and salts thereof. A particularly preferred compound of this type is dodecenylsuccinic acid. Specific examples of succinate builders include laurylsuccinate, myristylsuccinate, palmitylsuccinate, 2-dodecenylsuccinate (preferred), 2-pentadecenylsuccinate, and the like. Laurylsuccinates are the preferred builders of this group.

Fatty acids, e.g., $C_{12}$–$C_{18}$ monocarboxylic acids such as oleic acid and/or its salts, can also be incorporated into the compositions alone, or in combination with the aforethe builders, especially titrate and/or the succinate builders, to provide additional builder activity. Such use of fatty acids will generally result in a diminution of sudsing.

Where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates can also be used.

The detergent compositions may contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator. The bleaching agents used can be any of the known bleaching agents useful for detergent compositions in textile cleaning or other cleaning purposes. These include oxygen bleaches, other bleaching agents, and perborate bleaches, e.g., sodium perborate.

Another category of bleaching agent that can be used are the percarboxylic acid bleaching agents and salts thereof. Suitable examples include magnesium monoperoxyphthalate hexahydrate, the magnesium salt of metachloro perbenzoic acid, 4-nonylamino-4-oxoperoxybutyric acid and diperoxydodecanedioic acid. Highly preferred bleaching agents also include 6-nonylamino-6-oxoperoxycaproic acid.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach can also be used.

A preferred percarbonate bleach comprises dry particles having an average particle size in the range from about 500 micrometers to about 1,000 micrometers, not more than about 10% by weight of the particles being smaller than about 200 micrometers and not more than about 10% by weight of the particles being larger than about 1,250 micrometers. Optionally, the percarbonate can be coated with silicate, borate or water-soluble surfactants.

Mixtures of bleaching agents can also be used. Peroxygen bleaching agents, the perborates, the percarbonates, etc., are preferably combined with bleach activators, which lead to the in situ production in aqueous solution (i.e., during the washing process) of the peroxy acid corresponding to the bleach activator. The nonanoyloxybenzene sulfonate (NOBS) and tetraacetyl ethylene diamine (TAED) activators are typical, and mixtures thereof can also be used.

Amido-derived bleach activators are preferred and examples of these bleach activators include (6-octanamidocaproyl) oxybenzenesulfonate, (6-nonanamidocaproyl) oxybenzenesulfonate, (6-decanamido-caproyl) oxybenzenesulfonate, and mixtures thereof. Another class of useful bleach activators comprises the benzoxazin-type activators. Still another class of preferred bleach activators includes the acyl lactam activators, especially acyl caprolactams and acyl valerolactams. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art. The use of manganese with various complex ligands to enhance bleaching is also known.

The compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

Other preferred optional ingredients include polymeric soil release agents, materials effective for inhibiting the transfer of dyes from one fabric to another during the cleaning process (i.e., dye transfer inhibiting agents), polymeric dispersing agents, suds suppressors, optical brighteners or other brightening or whitening agents, chelating agents, fabric softening clay, anti-static agents, other active ingredients, carriers, hydrotropes, processing aids, dyes or pigments, solvents for liquid formulations, solid fillers for bar compositions, etc.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used. The compositions may contain from 5% to 90%, typically 10% to 50% of such carriers.

Granular detergents can be prepared, for example, by spray-drying (final product density about 520 g/1) or agglomerating (final product density above about 600 g/l) the Base Granule. The remaining dry ingredients can then be admixed in granular or powder form with the Base Granule, for example in a rotary mixing drum, and the liquid ingredients (e.g., nonionic surfactant and perfume) can be sprayed on.

The detergent compositions will preferably be formulated such that, during use in aqueous cleaning operations, the wash water will have a pH of between about 6.5 and about 11, preferably between about 7.5 and 10.5. Laundry products are typically at pH 9–11. Techniques for controlling pH at recommended usage levels include the use of buffers, alkalis, acids, etc., and are well known.

Throughout this application, various publications have been referenced. The disclosures in these publications are incorporated herein by reference in order to more fully describe the state of the art.

The present invention is further illustrated by the following examples which are not intended to limit the effective scope of the claims. All parts and percentages in the examples and throughout the specification and claims are by weight of the final composition unless otherwise specified.

EXAMPLE 1

In the following examples, the malodor counteractants employed are designated as follows:

Veilex No.1 1-Cyclohexyl-ethyl-butyrate $(C_6H_{11})CH(CH_3)OCO(CH_2)_2CH_3$

Veilex No.2 1-Cyclohexyl-ethyl-acetate $(C_6H_{11})CH(CH_3)OCOCH_3$

Veilex No.3 1-Cyclohexyl-ethanol $(C_6H_{11})CH(CH_3)OH$

Veilex No.4 4-Isopropyl-cyclohexyl-propionate $4\text{-}[(CH_3)_2CH(C_6H_{11})]OCOCH_2CH_3$ Veilex No.5 Phenoxyacetic acid 2-hydroxy-ethyl ester $(C_6H_5)OCH_2COO(CH_2)_2OH$ Indonesian Lux Shower Cream MOC (Maloder counteractant) Base Development Step 1—Limited Raw Material Testing Perfumed and unperfumed shower cream bases were provided so we could develop an MOC Base to counteract the base odor of the shower cream. The aim is to reduce the fragrance level that is needed by the addition of an MOC base, so that the cost of the two gives a cost saving over the cost of the fragrance on its own. For development purposes an arbitrary starting point was chosen for comparison of a 20% cut in fragrance, which is achieved by cutting the perfumed base with 20% of unperfumed base. The following 20 g samples in 30 g glass jars, were made.

Unperfumed Shower Cream.

Perfumed Shower Cream.

80% Perfumed/20% Unperfumed Shower Cream.

Veilex No.1 50% Solution in DPG @ 0.1% in 80/20 Shower Cream.

Veilex No.2 50% Solution in DPG @ 0.1% in 80/20 Shower Cream.

Veilex No.3 50% Solution in DPG @ 0.1% in 80/20 Shower Cream.

Veilex No.4 50% Solution in DPG @ 0.1% in 80/20 Shower Cream.

Assessment of these samples over the following few days, together with assessment of some packaging, suggested that the off odor was a combination of base and pack interactions. Therefore further samples were made up using 40 g base in a 100 g HDPE pack. Veilex No.3 was also rejected because of the strong base odor that it imparts to the base. The following samples were prepared.

Veilex No.1 50% Solution in DPG @ 0.1% in 80/20 Shower Cream.

Veilex No.2 50% Solution in DPG @ 0.1% in 80/20 Shower Cream.

Veilex No.4 50% Solution in DPG @ 0.1% in 80/20 Shower Cream.

Lilestralis @ 0.05% in 80/20 Shower Cream.

Tetra Hydro Linalol @ 0.05% in 80/20 Shower Cream.

Linalol @ 0.05% in 80/20 Shower Cream.

Lyral @ 0.05% in 80/20 Shower Cream.

Phenyl Propyl Alcohol @ 0.05% in 80/20 Shower Cream.

Perfumed Shower Cream.

80/20 Shower Cream.

Comparison was made of 9 and 10 to assess the level of improvement that needs to be achieved. Items 3, 7, and 8 appeared to have the best effects with respect to taking 10 closer to 9. The effects were as follows:

3) Veilex No.4 puts back some creaminess to be found in 9.

7) Lyral puts back some of the freshness to be found in 9.

8) Phenyl Propyl Alcohol puts back some of the powderyness to be found in 9, but adds another odor of its own.

Step 2—Combination Testing

It was decided to try a couple of bases in an 80/20 mix.

| | ZT7567 (Z3052D) | ZT8008 (Z3052M) |
|---|---|---|
| Ambroxan 10% in IPM | | 0.5 |
| Boisvelone | | 9.5 |
| Lyral | 10 | 10 |
| Phenyl Propyl Alcohol | 40 | 30 |
| Veilex No. 2 | 10 | 10 |
| Veilex No. 4 | 40 | 40 |
| Total | 100 | 100 |

ZT8008 had a much better effect than ZT7567, so it was decided to first check out the effect that the level of the phenyl propyl alcohol was having. So the following formulations were added at 0.1% in the 80/20 mix:

| | Z3059A | Z3059B | Z3059C |
|---|---|---|---|
| Dipropylene Glycol | 40 | 30 | 20 |
| Phenyl Propyl Alcohol | 20 | 30 | 40 |
| Veilex No. 4 | 40 | 40 | 40 |
| Total | 100 | 100 | 100 |

The Veilex needs the Phenyl Propyl Alcohol to be at an elevated level, with the lower level of Phenyl Propyl Alcohol in A the reduction on fragrance level by 20% is noticeable as a lack of body, which is compensated for as the level of Phenyl Propyl Alcohol is increased.

| | Z3059D | Z3059E |
|---|---|---|
| Dipropylene Glycol | 30 | 40 |
| Phenyl Propyl Alcohol | 40 | 40 |
| Veilex No. 4 | 30 | 20 |
| Total | 100 | 100 |

As Veilex No.4 represents the major cost component in the MOC base, formula Z3059C, Z3059D and Z3059E were assessed to see if the level could be reduced. The findings were that the highest level of the Veilex No. 4 proved the most effective.

| | Z3059F | Z3059G |
|---|---|---|
| Dipropylene Glycol | 10 | 0 |
| Phenyl Propyl Alcohol | 40 | 40 |
| Veilex No. 4 | 40 | 40 |
| Veilex No. 2 | 10 | 20 |
| Total | 100 | 100 |

Next an assessment was made of the contribution of Veilex No.2 was making to the formula ZT8008, by comparing Z3059C with Z3059F and Z3059G, which corresponds to 0, 10 and 20% Veilex No.2 respectively. Z3059F proved to be the optimum, the fragrance top note comes through better at this level of Veilex No.2, the balance is up set at the higher level, and the fragrance appears flatter and heavier without the Veilex No.2 in formula Z3059C.

| | Z3059H | Z3059I |
|---|---|---|
| Dipropylene Glycol | 15 | 10 |
| Lyral | 5 | 10 |
| Phenyl Propyl Alcohol | 40 | 40 |
| Veilex No. 4 | 40 | 40 |
| Total | 100 | 100 |

The next step was to assess the importance of Lyral in ZT8008 for this Z3059C was compared with Z3059H and Z30591, which corresponds to 0, 5 and 10% Lyral respectively. 5% Lyral is a definite improvement over no Lyral, but the increased benefit of including 10% is not so obvious.

| | Z3059J | Z3059K |
|---|---|---|
| Dipropylene Glycol | 5 | 0 |
| Lyral | 5 | 10 |
| Phenyl Propyl Alcohol | 40 | 40 |
| Veilex No. 4 | 40 | 40 |
| Boisvelone | 9.5 | 9.5 |
| Amberoxan (10% in IPM) | 0.5 | 0.5 |
| Total | 100 | 100 |

The test on the levels of Lyral was repeated with the inclusion of the inclusion of Boisvelone and the Ambroxan Solution, Z3059J and Z3059K. The difference again is not very great, but ZT8008 is still a significant improvement over these formulations.

Therefore in conclusion there may be some room to shave a small amount of cost off the ZT8008 by reducing the level of Lyral, but for performance, is pretty near optimal, without doing a large scale screening program to find materials that are more effective.

EXAMPLE 2

Thai Lux Extra Treatment Conditioner—Samples reassessed of Veilex 1–4 made up in base at 0.05%.

Veilex No. 2—flattens off impact of base odour.

Veilex No. 3—fresh green odour of this material cuts into the base odour.

Veilex No. 1 has little effect.

Veilex No. 4 cuts into top note, leaves fatty base odour behind.

Z3052M dosed at 0.1% appears to work like a masking fragrance rather being a neutral MOC base.

From these results, it was decided to proceed with a range of perfume raw materials made up at 0.05% in base together with the following ratios of Veilex No's 2/3:80:20, 50:50 and 20:80.

Materials to be Ruled Out:

Ratios of Veilex No.3 to 2 offer no advantage over straight Veilex No. 2, it only adds to one's awareness that an additive is present.

Menthanyl Acetate—Enhances base odour.

Nopyl Acetate—Enhances base odour.

Phenyl Ethyl Alcohol—Too perfumistic, does not cut into base odour.

Lilestralis—Blends with base odour, does not cut into it.

Benzyl Benzoate—Has little effect.

Di Hydro Terpineol—Too perfumistic, does not cut into base odour.

Vertenex—Has some effect but P-tertiary Butyl Cyclo Hexyl Acetate is better.

Benzyl Salicylate—Too perfumistic, does not cut into base odour.

Amyl Salicylate—Enhances base odour.

Citronellol 950—Too perfumistic, does not cut into base odour.

Tetra Hydro Geraniol—Strong chemical odour along side base odour.

Marginal Materials:

Tetra Hydro Linalol—some reduction in base odour, imparts fresh odour.

Amyl Cinnamic Aldehyde—Some suppression of base odour.

Abbalide IPM—Lower perception of base odour, with strong musky odour.

Phenyrat—Some suppression of base odour.

Good Materials:

Linalol—Good suppression of base odour, but also imparts strong floral odour, try at a lower dosage.

3,5,5,-Tri Methyl Hexyl Acetate—Flattens off top note of base odour.

Phenyl Propyl Alcohol—Good suppression of base odour, but material odour is obvious.

P-tertiary Butyl Cyclo Hexyl Acetate—Moderate base odour suppression, woody note evident Phenoxy Ethanol—Moderate base odour suppression.

From these results, a further range of blends and dosages were made to be assessed.

Veilex 2 and 4 assessed again—No. 4 has the edge at cutting into the medicinal odour of the base, but leaves a fatty odour behind. No. 2 reduces the odour as a whole, but not as much as No. 4 reduces the medicinal odour.

Veilex 2/4—80/20, 50/50, 20/80—20/80 has the best effect, appears to be marginally better than Veilex No.4 on its own, but this effect is not picked out consistently when smelled blind.

Veilex 2/3—95/5 no noticeable improvement over no. 2 straight.

Veilex 4/3—95/5 slight improvement over straight 4.

Linalol at 0.01% rather than 0.05% neutralisation becomes more evident as characteristic floral odour is reduced.

Z3052M at 0.05% rather than 0.1% neutralisation reasonable, some where between the two dosages would be better if the base can be made more neutral while maintaining the suppression.

The following two groups of formulations were made and assessed.

| | Z3062A | Z3062B | Z3062C | Z3062D |
|---|---|---|---|---|
| Dipropylene Glycol | 30 | 30 | 30 | 30 |
| Linalol | 20 | 20 | 20 | 20 |
| Veilex No. 4 | 50 | 40 | 40 | 40 |
| Veilex No. 2 | 00 | 10 | 7.5 | 05 |
| Veilex No. 3 | 00 | 00 | 2.5 | 05 |
| Total | 100 | 100 | 100 | 100 |

The optimum was Z3062B, the addition of Veilex No.2 produced a much more rounded effect than the straight Veilex No.4 in Z3062A. The further addition of Veilex No. 3 unbalanced the mixture and reduced the effectiveness.

| | Z3062E | Z3062F | Z3062G | Z3062H |
|---|---|---|---|---|
| Dipropylene Glycol | 30 | 30 | 30 | 30 |
| Veilex No. 4 | 50 | 50 | 50 | 50 |
| Phenyl Propyl Alcohol | 20 | 00 | 00 | 00 |
| P-Tertiary Butyl Cyclohexyl Acetate | 00 | 20 | 00 | 00 |
| Phenoxy Ethanol | 00 | 00 | 20 | 00 |
| 3,5,5-Trimethylhexyl Acetate | 00 | 00 | 00 | 20 |
| Total | 100 | 100 | 100 | 100 |

In this second group, Z3062A containing Linalol was used as the standard, Z3062F containing PTBCHA has a strong woody odour and does not cover base. Also Phenoxy Ethanol in Z3062F does not cover the base. Z3062E containing Phenyl Propyl Alcohol covers the base, but is quite perfumistic. Z3062H containing 3,5,5-Tri Methyl Hexyl Acetate has similar base coverage to Z3062A with Linalol, but is more neutral, less perfumistic.

The invention being thus described, it will be obvious that the same may be varied in many ways. Such variations are not to be regarded as a departure from the spirit and scope of the invention and all such modifications are intended to be included within the scope of the following claims.

I claim:

1. A method of counteracting a malodor in a solid or liquid, soap or detergent caused by a compound selected from the group consisting of lower aliphatic carboxylic acids, phenols, phosphines, arsines, lower alcohols, and lower ketones, comprising introducing into the solid or liquid, soap or detergent an effective malodor counteracting amount of a malodor counteracting compound selected from the group consisting of 1-cyclohexyl-ethyl-butyrate, 1-cyclohexyl-ethyl-acetate, 1-cyclohexyl-ethanol, 4-isopropyl-cyclohexyl-propionate, and phenoxyacetic acid 2-hydroxy-ethyl ester, whereby the perceived total odor intensity in the solid or liquid, soap or detergent is reduced and the perceived malodor intensity in the solid or liquid, soap or detergent is reduced or eliminated.

2. The method according to claim 1, wherein the malodor is caused by a lower aliphatic carboxylic acid.

3. The method according to claim 1, wherein the malodor counteracting compound is selected from the group consisting of 1-cyclohexyl-ethyl-butyrate, 1-cyclohexyl-ethyl-acetate, 1-cyclohexyl-ethanol, and 4-isopropyl-cyclohexyl-propionate.

4. The method according to claim 3, wherein the malodor counteracting compound is introduced into the solid or liquid, soap or detergent together with a fragrance material and the perceived total odor intensity in the solid or liquid, soap or detergent is reduced and the perceived malodor intensity in the solid or liquid, soap or detergent is reduced or eliminated.

5. The method according to claim 3, wherein the malodor counteracting compound is 1-cyclohexyl-ethanol or 4-isopropyl-cyclohexyl-propionate.

6. The method according to claim 5, wherein the malodor counteracting compound is introduced into the solid or liquid, soap or detergent together with a fragrance material and the perceived total odor intensity in the solid or liquid, soap or detergent is reduced and the perceived malodor intensity in the solid or liquid, soap or detergent is reduced or eliminated.

7. The method according to claim 1, wherein the malodor counteracting compound is 1-cyclohexyl-ethyl-butyrate.

8. The method according to claim 7, wherein the malodor counteracting compound is introduced into the solid or liquid, soap or detergent together with a fragrance material and the perceived total odor intensity in the solid or liquid, soap or detergent is reduced and the perceived malodor intensity in the solid or liquid, soap or detergent is reduced or eliminated.

9. The method according to claim 1, wherein the malodor counteracting compound is 1-cyclohexyl-ethyl-acetate.

10. The method according to claim 9, wherein the malodor counteracting compound is introduced into the solid or liquid, soap or detergent together with a fragrance material and the perceived total odor intensity in the solid or liquid, soap or detergent is reduced and the perceived malodor intensity in the solid or liquid, soap or detergent is reduced or eliminated.

11. The method according to claim 1, wherein the malodor counteracting compound is 1-cyclohexyl-ethanol.

12. The method according to claim 11, wherein the malodor counteracting compound is introduced into the solid or liquid, soap or detergent together with a fragrance material and the perceived total odor intensity in the solid or liquid, soap or detergent is reduced and the perceived malodor intensity in the solid or liquid, soap or detergent is reduced or eliminated.

13. The method according to claim 1, wherein the malodor counteracting compound is 4-isopropyl-cyclohexyl-propionate.

14. The method according to claim 13, wherein the malodor counteracting compound is introduced into the solid or liquid, soap or detergent together with a fragrance material and the perceived total odor intensity in the solid or liquid, soap or detergent is reduced and the perceived malodor intensity in the solid or liquid, soap or detergent is reduced or eliminated.

15. The method according to claim 1, wherein the malodor counteracting compound is phenoxyacetic acid 2-hydroxy-ethyl ester.

16. The method according to claim 15, wherein the malodor counteracting compound is introduced into the solid or liquid, soap or detergent together with a fragrance material and the perceived total odor intensity in the solid or liquid, soap or detergent is reduced and the perceived malodor intensity in the solid or liquid, soap or detergent is reduced or eliminated.

17. The method according to claim 1, wherein the malodor counteracting compound is introduced into the solid or liquid, soap or detergent together with a fragrance material and the perceived total odor intensity in the solid or liquid, soap or detergent is reduced and the perceived malodor intensity in the solid or liquid, soap or detergent is reduced or eliminated.

18. The method according to claim 1, wherein the malodor counteracting compound is a mixture of cyclohexyl-ethyl-acetate and 4-isopropyl-cyclohexyl-propionate.

19. The method according to claim 18, comprising introducing into the solid or liquid, soap or detergent an effective malodor counteracting amount of a mixture comprising from about 0.5% to about 10% of a solution of ambroxan in dipropylene glycol, about 9.5% of boisvelone, about 10% of lyral, about 30% of phenyl propyl alcohol, about 10% of 1-cyclohexyl-ethyl-acetate, and about 40% of 4-isopropyl-cyclohexyl-propionate.

* * * * *